US005551835A

United States Patent [19]

Yu et al.

[11] Patent Number: 5,551,835

[45] Date of Patent: Sep. 3, 1996

[54] AUTOMOTIVE FUEL PUMP HOUSING

[75] Inventors: Dequan Yu, Ann Arbor; Harold L. Castle, Dexter, both of Mich.

[73] Assignee: Ford Motor Company, Dearborn, Mich.

[21] Appl. No.: 566,210

[22] Filed: Dec. 1, 1995

[51] Int. Cl.[6] ..... F04D 9/00

[52] U.S. Cl. ..... 415/55.1; 417/423.14

[58] Field of Search ..... 415/55.1, 55.2, 415/55.3, 55.4, 55.5, 55.6, 55.7, 1; 417/312, 423.14

[56] References Cited

U.S. PATENT DOCUMENTS

| | | | |
|---|---|---|---|
| 2,724,338 | 5/1949 | Roth . | |
| 3,881,839 | 6/1975 | MacManus . | |
| 3,963,371 | 6/1976 | Sieghartner . | |
| 4,231,718 | 11/1980 | Ruhl et al. . | |
| 4,650,404 | 3/1987 | Kusakawa . | |
| 4,723,888 | 2/1988 | Watanabe . | |
| 4,793,766 | 12/1988 | Kumata . | |
| 5,024,578 | 6/1991 | Vansadia . | |
| 5,310,308 | 5/1994 | Yu et al. . | |
| 5,330,319 | 7/1994 | Yu et al. . | |
| 5,336,045 | 8/1994 | Koyama et al. . | |
| 5,364,238 | 11/1994 | Yu . | |
| 5,401,147 | 3/1995 | Yu | 415/55.1 |
| 5,409,357 | 4/1995 | Yu et al. | 415/55.1 |

FOREIGN PATENT DOCUMENTS

| | | | |
|---|---|---|---|
| 1385066 | 11/1964 | France | 415/55.1 |

*Primary Examiner*—Edward K. Look
*Assistant Examiner*—Christopher Verdier
*Attorney, Agent, or Firm*—Neil P. Ferraro

[57] ABSTRACT

An automotive fuel pump housing for a fuel pump encases a rotary pumping element. The housing has two portions, a cover and a bottom. The cover has an inlet port which defines a directional control surface having an inclined frustoconical portion and an inclined planar portion conjoined therewith and laterally extending therefrom such that fuel flowing over the inclined frustoconical portion accelerates primarily radially and combines with fuel flowing primarily axially over the inclined planar portion, whereby the combined flow is smoothly directed to an annular cover channel. The bottom has an annular bottom channel which, when the cover and bottom are assembled, the annular cover channel and annular bottom channel cooperate to form the inlet channel. A transition section is located at the beginning of the inlet channel and extends along a portion of the arc of the inlet channel. The transition section decreases in depth from a maximum depth at the beginning thereof to the depth of the remaining portion of the inlet channel. The annular cover channel has a two-step transition section depth whereas the annular bottom channel has a single-step transition section depth. In addition, the radius of the base circle of the inlet channel outside of the transition section is not less than the radius of the rotary pumping element near the vane grooves.

20 Claims, 3 Drawing Sheets

AUTOMOTIVE FUEL PUMP HOUSING

FIELD OF THE INVENTION

This invention relates to automotive fuel pumps, and, in particular, to a fuel pump housing having an inlet port and inlet channel configured for smooth directional control of the pumped fluid during high temperature fluid operation.

BACKGROUND OF THE INVENTION

Conventional tank-mounted automotive fuel pumps typically have a rotary pumping element encased within a pump housing. Fuel flows into a pumping chamber within the pump housing and the rotary pumping action of the vanes and the vane grooves of the rotary pumping element cause the fuel to exit the housing at a higher pressure. Regenerative turbine fuel pumps are commonly used to pump fuel to automotive engines because they have a higher and more constant discharge pressure than, for example, positive displacement pumps. In addition, regenerative turbine pumps typically cost less and generate less audible noise during operation. A problem may develop, however, when the pump pumps high temperature fuel at a high flow rate. When high temperature fuel (140° F.–160° F.) is pumped at high velocity (which is required at high engine demand), cavitation may occur, which in turn, causes pump flow to drop by as much as 40%. Thus, a single stage pump may be unable to meet high engine demand by preventing cavitation. Prior art devices overcome this problem by utilizing an expensive two-stage pump. The present invention, on the other hand, overcomes this problem utilizing a low cost, single-stage pump having a unique inlet port and channel configuration that improves the net positive suction head (NPSH) and hot fuel handling capability by reducing inlet flow losses and cavitation, both of which would otherwise cause fuel vaporization and audible noise.

Accordingly, an advantage of the present invention is that hot fuel handling is improved by reducing inlet flow losses and cavitation.

Another advantage of the present invention is that a low cost, single stage pump can be used to pump high temperature fuel at high velocity.

Still another advantage of the present invention is that fuel vaporization and audible noise is reduced.

SUMMARY OF THE INVENTION

According to the present invention, a fuel pump for supplying fuel from a fuel tank to an automotive engine includes a pump casing; a motor mounted within the casing and having a shaft extending therefrom; and, a rotary pumping element slidingly engaged onto the shaft and having a plurality of vanes around and inner circumference. The inner circumference defines a rotary pumping element inner radius. A pump housing is mounted within the pump casing and encases the rotary pumping element therein. The pump housing includes a cover having an inlet port with an axis and an annular cover channel in fluid communication with the inlet port. The inlet port has a directional control surface defined by an inclined frustoconical portion and an inclined planar portion conjoined therewith and laterally extending therefrom such that fuel flowing over the inclined frustoconical portion accelerates primarily radially and combines with fuel flowing primarily axially over the inclined planar portion, whereby the combined flow is smoothly directed to the annular cover channel. The pump housing also includes a bottom having an annular bottom channel in fluid communication with the annular cover channel and a fuel outlet port in fluid communication with the annular bottom channel.

Also, according to the present invention, a pump housing for an automotive fuel pump includes a cover having an inlet port with an axis and an annular cover channel in fluid communication with the inlet port. The inlet port is provided with a directional control surface defined by an inclined frustoconical portion and an inclined planar portion conjoined therewith and laterally extending therefrom such that fuel flowing over the inclined frustoconical portion accelerates primarily radially and combines with fuel flowing primarily axially over the inclined planar portion, whereby the combined flow is smoothly directed to the annular cover channel. The housing also includes a bottom having an annular bottom channel in fluid communication with the annular cover channel, when assembled therewith, and a fuel outlet port in fluid communication with the annular bottom channel.

Also, according to the present invention, a method of directing fuel entering a fuel pump includes the steps of providing a fuel pump cover with an inlet port and an annular cover channel in fluid communication with the inlet port; and providing the inlet port with a directional control surface. The directional control surface is defined by an inclined frustoconical portion and an inclined planar portion conjoined therewith and laterally extending therefrom such that fuel flowing over the inclined frustoconical portion accelerates primarily radially and combines with fuel flowing primarily axially over the inclined planar portion, whereby the combined flow is smoothly directed to the annular cover channel. The method also includes the step of providing a fuel pump bottom with an annular bottom channel in fluid communication with said annular cover channel, when assembled therewith. The fuel pump bottom is also provided with a fuel outlet port in fluid communication with the annular bottom channel.

DETAILED DESCRIPTION OF THE PREFERRED EMBODIMENT

Figure 1:
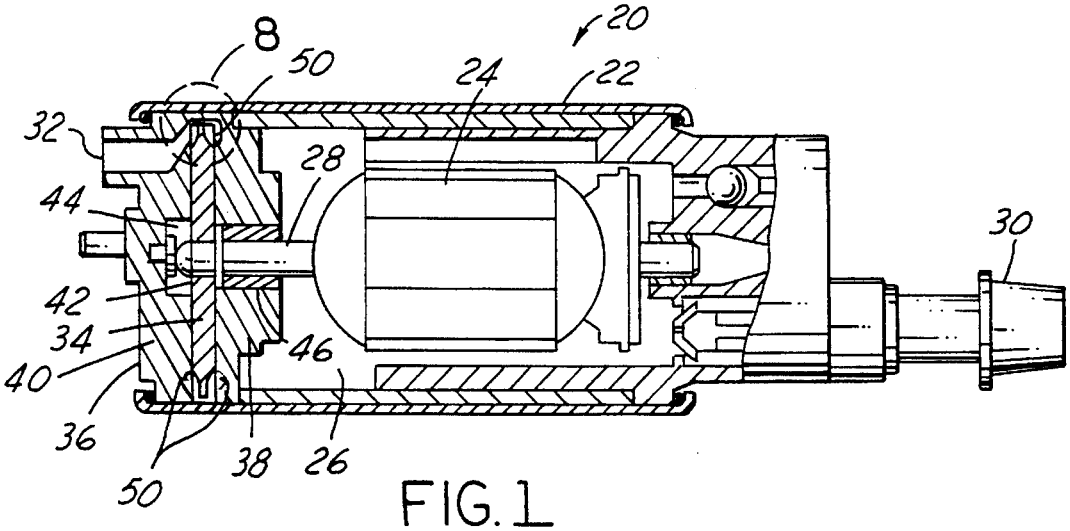
FIG. 1 is a cross-sectional view of a fuel pump according to the present invention.

Referring now to FIG. 1, fuel pump 20 has casing 22 for containing motor 24, preferably an electric motor, which is mounted within motor space 26. Motor 24 has shaft 28 extending therefrom in a direction from fuel pump outlet 30 to fuel inlet 32. Rotary pumping element 34, preferably an impeller, or, alternatively, a regenerative turbine, is slidingly engaged onto shaft 28 and encased within pump housing 36, which is composed of pump bottom 38 and pump cover 40 according to the present invention. Rotary pumping element 34 has a central axis which is coincident with the axis of shaft 28. Shaft 28 passes through shaft opening 42 of rotary pumping element 34 and into cover recess 44 of pump cover 40. As seen in FIG. 1, shaft 28 journalled within bearing 46. Pump bottom 38 has fuel outlet 48 (shown in FIG. 11) leading from pumping chamber 50 formed along the periphery of rotary pumping element 34. In operation, fuel is drawn from a fuel tank (not shown), in which pump 20 may be mounted, through fuel inlet 32 in pump cover 40, and into pumping chambers 50 by the rotary pumping action of rotary pumping element 34. Pressurized fuel is discharged through fuel outlet 48 to motor space 26 and cools motor 24 while passing over it to fuel pump outlet 30.

Figure 2:
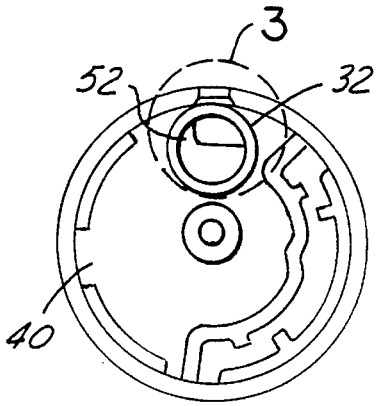
FIG. 2 is a plan view of the outside of a fuel pump cover showing the inlet port of the present invention.
Figure 3:
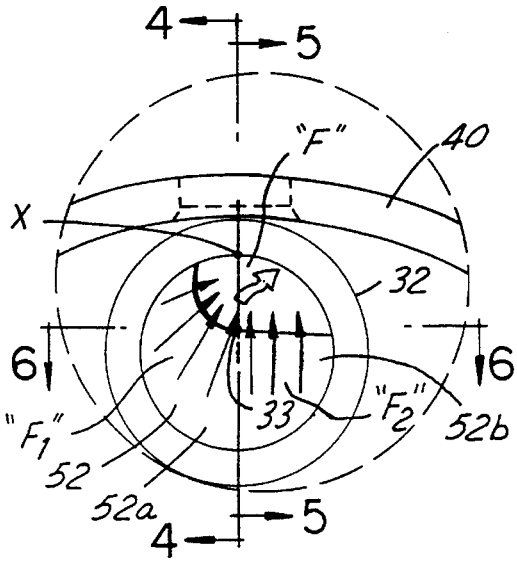
FIG. 3 is an enlarged view of the inlet port encircled by line 3 of FIG. 2.
Figure 9:
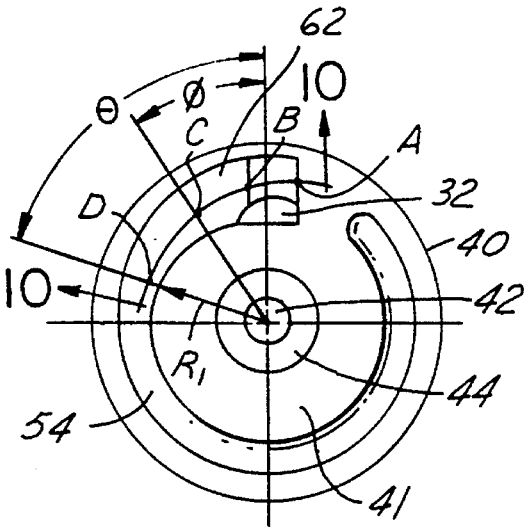
FIG. 9 is a plan view of the inside of the fuel pump cover showing the inlet port and the cover channel of the present invention.

As shown in FIGS. 2 and 3, fuel inlet 32 is formed in pump cover 40 such that directional control surface 52 directs fuel from fuel inlet 32 into annular cover channel 54 (See FIG. 9). FIG. 3 shows directional control surface 52 having an inclined frustoconical portion **52*a* on the left relative to the beginning of annular cover channel 54, with its apex located on a line parallel to, but spaced from, axis 33 of fuel inlet 32 (shown at point "X" in FIG. 3) such that fuel entering fuel inlet 32 is directed toward the right and into the plane of the page, shown as flow arrows "$F_1$". FIG. 3 further shows directional control surface 52 having an inclined planar portion 52*b* on the right relative to the beginning of annular cover channel 54, conjoined with and laterally extending from frustoconical portion 52*a*, such that fuel entering inlet 32 is directed upward and into the plane of the page, shown as flow arrows "$F_2$". The result is that the fuel exits inlet 32 at a resultant angle toward annular cover channel 54 shown as flow arrow "F". For the sake of the example shown in FIG. 3, frustoconical portion 52*a* is shown to the left of inclined planar 52*b*; however, the location and inclination of portions 52*a* and 52*b* are relative to the beginning of annular cover channel 54. That is, if annular cover channel 54 is shown counterclockwise with rotary pumping element 34 rotating counterclockwise, then inclined frustoconical portion 52*a* would be on the right of inclined planar portion 54*b*. Similarly, if annular cover channel 54 is positioned closer to the central axis of rotary pumping element 34, when assembled, frustoconical portion 52*a* and inclined planar portion 52*b*** may be inclined downward.

It should be noted that a completely planar inlet (no frustoconical portion) causes significant losses as the fuel turns to enter the inlet channel. On the other hand, a completely frustoconical inlet (no planar portion) is too restrictive because the fuel is directed toward the apex of the frustoconical portion and the fuel flow rate is reduced. According to the present invention having both a frustoconical portion and a planar portion, fuel flowing over frustoconical portion **52*a* accelerates primarily radially and combines with fuel flowing primarily axially over planar portion 52*b*, whereby the combined flow is smoothly directed to annular cover channel 54** at an acceptable fuel flow rate with minimal losses.

Figure 4:
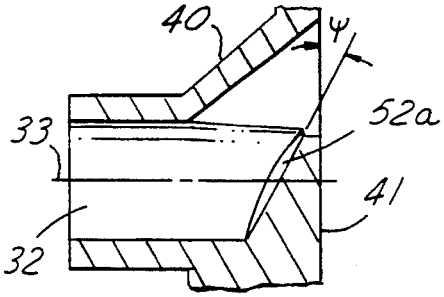
FIG. 4 is a cross-sectional view taken along line 4—4 of FIG. 3 showing an inclined frustoconical portion of an directional control surface of the inlet port.
Figure 5:
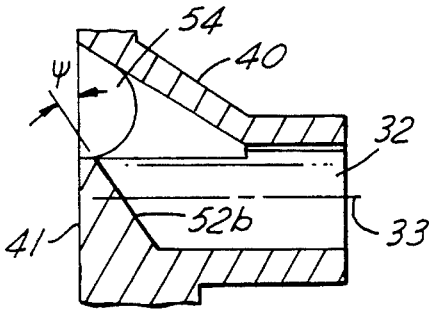
FIG. 5 is a cross-sectional view taken along line 5—5 of FIG. 3 showing an inclined planar portion of the directional control surface of the inlet port.
Figure 6:
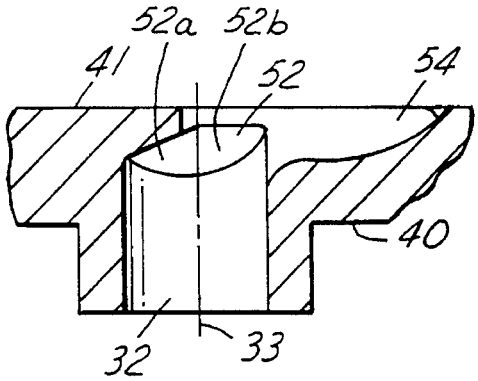
FIG. 6 is a cross-sectional view taken along line 6—6 of FIG. 3 showing the directional control surface of the inlet port.
Figure 7:
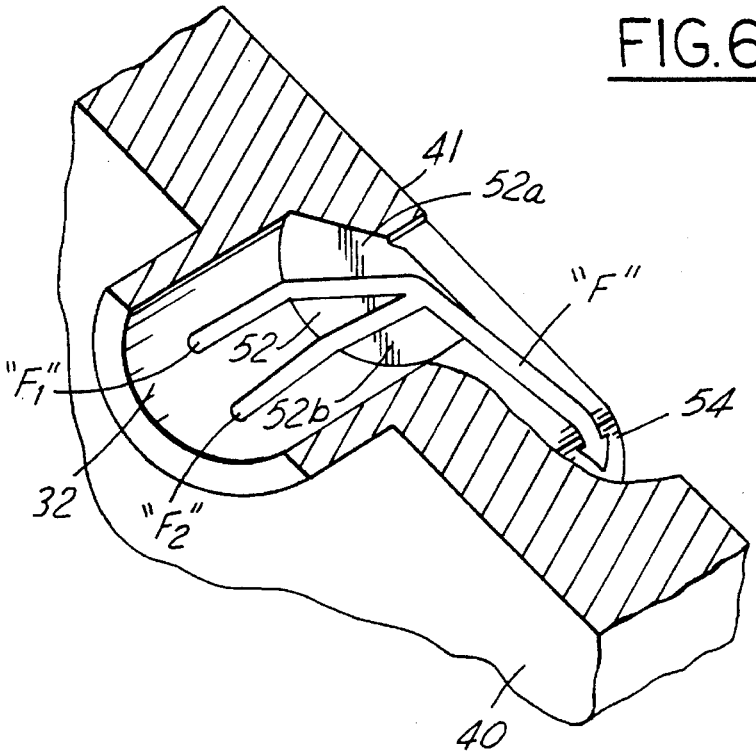
FIG. 7 is a perspective sectional view of FIG. 6 showing the directional control surface of the inlet port.

FIGS. 4–7 best show inclined frustoconical portion **52*a* and inclined planar portion 52*b*. FIG. 4 is a cross-sectional view of FIG. 3 taken along line 4—4 which shows inclined frustoconical portion 52*a* of directional control surface 52. FIG. 5 is a cross-sectional view of FIG. 3 taken along line 5—5 which shows inclined planar portion 52*b* of directional control surface 52. FIG. 6 is a cross-sectional view of FIG. 3 taken along line 6—6 showing both portions (52*a* and 52*b*) of directional control surface 52 in communication with annual cover channel 54. As best shown in perspective view by flow arrow "F" in FIG. 7, as fuel enters fuel inlet 32, directional control surface 52 smoothly directs the fuel toward annular cover channel 54. As is well known in the art, annular cover channel 54 and annular bottom channel 56 (see FIG. 11), when assembled, cooperate with vane grooves 58 (see FIG. 8) of rotary pumping element 34 to form pumping chamber 50. Rotary pumping action of vanes 60 on rotary pumping element 34 propels primary vortices circumferentially around annular pumping chamber 50. Vanes 60 then carry the fuel to fuel outlet 48 (see FIG. 11) at the end of annular bottom channel 56 of pump bottom 38 where the fuel exits at high pressure. According to the present invention, directional control surface 52 smoothly guides fuel into annular cover channel 54 and annular bottom channel 56 to improve the net positive suction head (NPSH) and hot fuel handling capability of fuel pump 20** by reducing the inlet flow losses and cavitation, both of which would otherwise cause fuel vaporization and audible noise.

Figure 8:
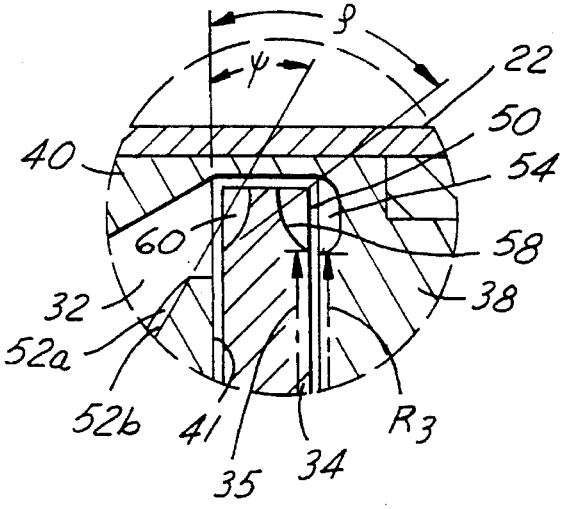
FIG. 8 is an enlarged view of a portion of the fuel pump encircled by line 8 of FIG. 1.

Referring to FIG. 8, a part of planar portion **52*b* is shown so that angle of inclination $\psi$ of planar portion 52*b* can be seen. Angle of inclination $\psi$ is shown relative to surface 41 of cover 40. Here, angle of inclination $\psi$ is shown non-tangential to rotary pumping element inlet angle $\rho$. That is, angle of inclination $\psi$ is less than rotary pumping element inlet angle $\rho$ by about 10° to about 45°. In a preferred embodiment, angle of inclination $\psi$ is about 33° and rotary pumping element inlet angle $\rho$ is about 75°. Angle of inclination $\psi$ can also be seen in FIGS. 4 and 5. This smaller angle of inclination $\psi$ with respect to inlet angle $\rho$ reduces the inlet velocity of the fuel at directional control surface 52, which unifies the fuel distribution throughout inlet port 32. Thus, cross-flow (fuel flow from inlet port 32 into annular bottom channel 56**) capability is improved.

Figure 11:
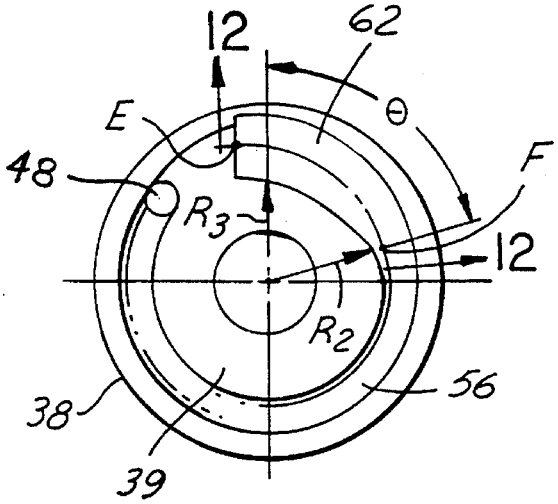
FIG. 11 is a plan view of the inside of the fuel pump bottom showing the bottom channel of the present invention; and, FIG. 12 is a cross-sectional view taken along arc 12—12 of FIG. 12 showing the profile of the bottom channel of the present invention.

Annular cover channel 54 and annular bottom channel 56 are both configured to form an inlet channel when assembled. The radius of the base circle of the inlet channel is preferably the same radius as inner radius 35 of rotary pumping element 34 defined by the bottom of the vane groove, at least for a portion of the inlet channel. That is, as seen in FIGS. 9 and 11, annular cover channel 54 and annular bottom channel 56 have a base circle radius of 12.5 mm as indicated by "$R_1$" and "$R_2$" in FIGS. 9 and 11, respectively, and inner radius 35 also has a radius of 12.5 mm. The purpose of this is to create a smooth transition for fuel flowing between vane grooves 58 and channels 54 and 56 (i.e. fuel flowing in pumping chamber 50). However, according to the present invention, transition section 62 (see FIG. 11) is provided in annular bottom channel 56 such that the radius previously described is slightly less than the radius of rotary pumping element 34 near the bottom of the vane groove as shown in FIG. 8. In transition section 62 of annular bottom channel 56, the base circle radius is about 12.3 mm, shown in FIGS. 8 and 11 as "$R_3$", near the beginning of annular bottom channel 56.

Figure 10:
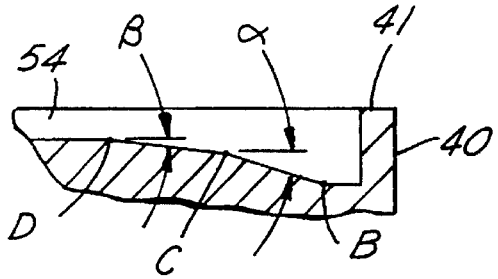
FIG. 10 is a cross-sectional view taken along arc 10—10 of FIG. 9 showing the profile of the cover channel of the present invention.
Figure 12:
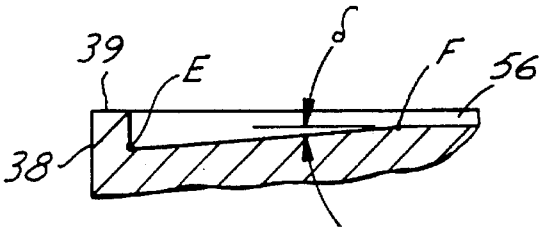

Further, according to the present invention, transition section 62 extends along an arc beginning at inlet axis 33 and having an angle θ of approximately 30°–60°, as shown in FIGS. 9 and 11, in which the depth of channels 54 and 56, as measured from surfaces 41 and 39, respectively, is greater than in the remaining portion of the channels. That is, with respect to cover 40, as shown in FIGS. 9 and 10, the depth of annular cover channel 54 is deeper at point "B" than at point "D", which demarcates the end of transition section 62. With respect to bottom 38, as shown in FIGS. 11 and 12, the depth of annular bottom channel 56 is deeper at point "E" than at point "F", which also demarcates the end of transition section 62.

Annular cover channel 54 has a two-step transition section 62 as best shown in FIG. 10 such that the depth of channel 54, as measured from surface 41, decreases from a maximum at point "B" to point "D" in two discrete steps. The first-step occurs between point "B" and point "C" in which the depth of annular cover channel 54 decreases linearly at an angle α between about 10° and 30°, preferably about 20°. Point "C" is located at an angle ϕ which is approximately 30° as measured along the arc of transition section 62 as shown in FIG. 9. The second-step is located between point "C" and point "D" in which the depth of annular cover channel 54 decreases linearly at an angle β of about 7°. As previously indicated, point "D" demarcates the end of transition section 62. Transition section 62 of annular bottom channel 56 also decreases in depth as measured from surface 39 from a maximum at point "E" to point "F". However, this transition occurs in a single-step. As shown in FIG. 12, the depth of annular bottom channel 56 decreases linearly at an angle δ of about 4.2° from point "E" at the beginning of transition section 62 to point "F" at the end of transition section 62.

This convergence of the inlet channel (as defined by annular cover channel 54 and annular bottom channel 56 when assembled) provides a smooth path for the fuel vortices to migrate toward fuel outlet 48 thereby reducing losses. In addition, the two-step transition in annular cover channel 54 improves NPSH capability. If a single step transition is used, the energy gain from rotary pumping element 34 will be delayed, which will result in undesirable cavitation.

In addition, according to the present invention, pump housing 36 may be formed of a plastic material, such as molded from phenolic, acetyl or other plastic which may or may not be glass-filled or of a non-plastic material known to those skilled in the art and suggested by this disclosure such as die cast in aluminum or steel.

While the best mode in carrying out the invention has been described in detail, those having ordinary skill in art in which this invention relates will recognize various alternative designs and embodiments, including those mentioned above, in practicing the invention that have been defined by the following claims.

We claim:

1. A fuel pump for supplying fuel from a fuel tank to an automotive engine, comprising:

a pump casing;

a motor mounted within said casing and having a shaft extending therefrom;

a rotary pumping element slidingly engaged onto said shaft and having a plurality of vanes around an inner circumference, said inner circumference defining a rotary pumping element inner radius; and a pump housing mounted within said pump casing and encasing said rotary pumping element therein, said pump housing comprising:

a cover having an inlet port with an axis and an annular cover channel in fluid communication with said inlet port, said inlet port comprising a directional control surface defined by an inclined frustoconical portion and an inclined planar portion conjoined therewith and laterally extending therefrom such that fuel flowing over said inclined frustoconical portion accelerates primarily radially and combines with fuel flowing primarily axially over said inclined planar portion, whereby the combined flow is smoothly directed to said annular cover channel; and, a bottom having an annular bottom channel in fluid communication with said annular cover channel and a fuel outlet port in fluid communication with said annular bottom channel.

2. A fuel pump according to claim 1 wherein said inclined frustoconical portion has an apex located on a line parallel to, but spaced from, said axis of said inlet port.

3. A fuel pump according to claim 1 wherein said inclined planar portion is inclined at an angle of inclination relative to surface of said cover that is less than an inlet angle of said rotary pumping element relative to said surface of said cover.

4. A fuel pump according to claim 3 wherein said angle of inclination is about 10° to about 40° less than said inlet angle of said rotary pumping element.

5. A fuel pump according to claim 4 wherein said angle of inclination is about 33°.

6. A fuel pump according to claim 4 wherein said inlet angle of said rotary pumping element is about 75°.

7. A fuel pump according to claim 1 wherein said annular cover channel has a base radius not less than said rotary pumping element inner radius.

8. A fuel pump according to claim 7 wherein said base radius is about 12.5 mm.

9. A fuel pump according to claim 1 wherein at least a portion of said annular bottom channel has a base radius not less than said rotary pumping element inner radius.

10. A fuel pump according to claim 9 wherein said base radius is about 12.5 mm.

11. A fuel pump according to claim 1 wherein said annular cover channel comprises a two-step transition section extending along an arc having an angle of about 30° to about 60° from said inlet port axis and defining a transition section depth, as measured from a surface of said cover, that is greater than an annular cover channel depth outside said transition section, the first-step in said transition section extends along an arc having an angle of about 30° from said inlet port axis and defines a depth greater than a depth in the second-step of said transition section.

12. A fuel pump according to claim 11 wherein the depth of said annular cover channel in said first-step as measured from a surface of said cover decreases linearly from a maximum depth to a depth beginning at the second-step at a first-step angle of about 10° to about 30°.

13. A fuel pump according to claim 12 wherein said first-step angle is 20°.

14. A fuel pump according to claim 11 wherein the depth of said second-step as measured from a surface of said cover decreases linearly from said first-step depth to said annular cover channel depth at a second-step angle of about 7°.

15. A fuel pump according to claim 1 wherein said bottom cover channel comprises a transition section extending along an arc having an angle of about 30° to about 60° from said inlet port axis, when assembled with said cover, and defining a transition section depth that is greater than an annular bottom channel depth outside said transition section.

16. A fuel pump according to claim 14 wherein the depth of said transition section as measured from a surface of said bottom decreases linearly from a maximum depth to the depth of said annular bottom channel depth at a single-step angle of about 4.2°.

17. A pump housing for an automotive fuel pump comprising:

a cover having an inlet port and an annular cover channel in fluid communication with said inlet port, said inlet port comprising a directional control surface defined by an inclined frustoconical portion and an inclined planar portion conjoined therewith and laterally extending therefrom such that fuel flowing over said inclined frustoconical portion accelerates primarily radially and combines with fuel flowing primarily axially over said inclined planar portion, whereby the combined flow is smoothly directed to said annular cover channel; and, a bottom having an annular bottom channel in fluid communication with said annular cover channel, when assembled therewith, and a fuel outlet port in fluid communication with said annular bottom channel.

18. A pump housing according to claim 17 wherein said inlet port has an axis and said inclined frustoconical portion has an apex located on a line parallel to, but spaced from, said axis of said inlet port and said inclined planar portion is inclined at an angle of about 33° relative to a surface of said cover, and wherein said annular cover channel and at least a portion of said annular bottom channel each have a base radius of about 12.5 mm;

said annular cover channel comprises a two-step annular cover channel transition section extending along an arc having an angle of about 60° from said inlet port axis and defining an annular cover channel transition section depth, as measured from said surface of said cover, that is greater than an annular cover channel depth outside said annular cover channel transition section, the first-step in said annular cover channel transition section extends along an arc having an angle of about 30° from said inlet port axis and defines a depth greater than a depth in the second-step of said annular cover channel transition section, the depth in said first-step decreases linearly from a maximum depth to a depth beginning at the second-step at a first-step angle of about 20°, the depth in said second-step decreases linearly from said first-step depth to said annular cover channel depth at a second-step angle of about 7°, and, said annular bottom channel comprises a single-step annular bottom channel transition section extending along an arc having an angle of about 60° from said inlet port axis, when assembled with said cover, and defining a single-step annular bottom channel transition section depth, as measured from a surface of said bottom, that is greater than an annular bottom channel depth outside said single-step annular bottom channel transition section, the depth of said single-step annular bottom channel transition section decreases linearly from a maximum depth to said annular bottom channel depth at an angle of about 4.2°.

19. A method of directing fuel entering a fuel pump comprising the steps of:

providing a fuel pump cover with an inlet port and an annular cover channel in fluid communication with said inlet port;

providing said inlet port with a directional control surface defined by an inclined frustoconical portion and an inclined planar portion conjoined therewith and laterally extending therefrom such that fuel flowing over said inclined frustoconical portion accelerates primarily radially and combines with fuel flowing primarily axially over said inclined planar portion, whereby the combined flow is smoothly directed to said annular cover channel; and, providing a fuel pump bottom with an annular bottom channel in fluid communication with said annular cover channel, when assembled therewith, and a fuel outlet port in fluid communication with said annular bottom channel.

20. A method according to claim 19 further comprising the steps of:

disposing said frustoconical portion such that an apex of said frustoconical surface is located on a line parallel to, but space from, an axis of said inlet port;

inclining said planar portion at an angle of about 33° relative to a surface of said cover;

providing said annular cover channel and at least a portion of said annular bottom channel each with a base radius of about 12.5 mm;

providing said annular cover channel with a two-step annular cover channel transition section;

extending said two-step annular cover channel transition section along an arc having an angle of about 60° from said inlet port axis;

providing said annular cover channel transition section with a depth, as measured from said surface of said cover, that is greater than an annular cover channel depth outside said annular cover channel transition section;

extending the first-step in said annular cover channel transition section along an arc having an angle of about 30° from said inlet port axis and providing the first-step with a depth that is greater than a depth in the second-step of said annular cover channel transition section;

linearly decreasing the depth in said first-step from a maximum depth to a depth beginning at the second-step at a first-step angle of about 20°;

linearly decreasing the depth in said second-step from said first-step depth to said annular cover channel depth at a second-step angle of about 7°;

providing said annular bottom channel with a single-step annular bottom channel transition section;

extending said annular bottom channel transition section along an arc having an angle of about 60° from said inlet port axis, when assembled with said cover;

providing said single-step annular bottom channel transition section with a depth, as measured from a surface of said bottom, that is greater than an annular bottom channel depth outside said annular bottom channel transition section; and, linearly decreasing the depth of said single-step annular bottom channel transition section from a maximum depth to said annular bottom channel depth at an angle of about 4.2°.

* * * * *